US005611457A

United States Patent [19]

Ash, Jr.

[11] Patent Number: 5,611,457

[45] Date of Patent: Mar. 18, 1997

[54] BACKPACK DISPENSING SYSTEM FOR BEVERAGE CONTAINERS

[76] Inventor: William O. Ash, Jr., 2537 S. Gessner, No. 216, Houston, Tex. 77063

[21] Appl. No.: 409,741

[22] Filed: Mar. 23, 1995

[51] Int. Cl.[6] ..... A45C 15/00

[52] U.S. Cl. ..... 221/185; 224/148.3; 40/538; 40/586

[58] Field of Search ..... 221/185, 155, 221/303, 306, 307, 309, 312 C, 61, 24, 281, 97, 98, 102, 150 R; 294/19.2; 224/148, 196, 210, 211, 236, 237, 148.3; 40/538, 586, 611

[56] References Cited

U.S. PATENT DOCUMENTS

| | | | |
|---|---|---|---|
| 2,513,455 | 4/1950 | Cornelius . | |
| 2,684,787 | 7/1954 | Charpiat | 222/175 |
| 2,704,627 | 3/1955 | Brulin et al. | 221/185 X |
| 2,732,977 | 1/1956 | Charpiat | 222/131 |
| 2,808,965 | 10/1957 | Graphia, III et al. . | |
| 3,147,889 | 9/1964 | Dolgin | 222/131 |
| 3,332,594 | 7/1967 | DeCapua | 224/196 X |
| 3,662,929 | 5/1972 | Sims . | |
| 4,098,434 | 7/1978 | Uhlig . | |
| 4,300,705 | 11/1981 | Shy . | |
| 4,369,591 | 1/1983 | Vicino | 40/611 X |
| 4,420,097 | 12/1983 | Motsenbocker . | |
| 4,420,103 | 12/1983 | Douglass | 224/210 |
| 4,526,298 | 7/1985 | Boxer et al. . | |
| 4,673,117 | 6/1987 | Calton . | |
| 4,721,237 | 1/1988 | Leslie . | |
| 4,869,402 | 9/1989 | Ash, Jr. . | |
| 4,921,143 | 3/1990 | Billet . | |
| 5,086,948 | 2/1992 | Slusarz | 221/185 |
| 5,095,718 | 3/1992 | Ormond et al. | 224/148 X |
| 5,184,763 | 2/1993 | Blaisdell et al. | 224/211 |
| 5,199,609 | 4/1993 | Ash, Jr. . | |
| 5,370,287 | 12/1994 | Cormier | 224/210 X |

FOREIGN PATENT DOCUMENTS

| | | | |
|---|---|---|---|
| 460460 | 1/1937 | United Kingdom | 221/307 X |

OTHER PUBLICATIONS

Rocket Man Inc. New Product Release "Canpak" p. 134, Oct. 1995 Issue, Beverage World Magazine.

Rocket Man Inc. New Product Release "Canpak" p. 50, Nov. 1995 Issue, Nightclub & Bar Magazine.

*Primary Examiner*—William E. Terrell
*Assistant Examiner*—Khoi H. Tran
*Attorney, Agent, or Firm*—Kenneth A. Roddy

[57] ABSTRACT

A backpack carried on the back of a vendor for transporting and dispensing individual cans or bottles of a beverage, has at least one thermally insulated generally rectangular storage compartment configured to hold a plurality of cans or bottles of a beverage in vertical descendable disposition, a closable lid at the top end of the backpack, and at least one access opening disposed at a lower end of the backpack in a position accessible to the hand of the person wearing the backpack. In a preferred embodiment, the backpack has a thermally insulated back wall, front wall, opposed side walls, bottom wall, and hinged top wall, a pair of laterally adjacent storage compartments, and a lower portion which extends laterally outward from the opposed side walls to define laterally opposed side extensions, and the back wall has a pair of laterally opposed access openings one in each side extension accessible to either hand of the person wearing the backpack by reaching rearwardly to manually withdraw a lowermost one of the cans or bottles from either storage compartment. A storage pouch may be releasably attached to the backpack to store empty cans or bottles. One or more panels may be installed on the exterior of the backpack which are imprinted with a picture or other advertising indicia to represent the type of beverage contained within the backpack. Alternatively, a hollow shell may be installed on the exterior of the backpack which is configured to resemble the shape of a beverage container of the type contained within the backpack.

19 Claims, 5 Drawing Sheets

BACKPACK DISPENSING SYSTEM FOR BEVERAGE CONTAINERS

BACKGROUND OF THE INVENTION

1. Field of the Invention

This invention relates generally to portable beverage dispensers carried on the back of a person, and more particularly to a backpack carried on the back of a vendor for transporting and dispensing individual cans or bottles of a beverage that has at least one thermally insulated generally rectangular storage compartment which holds a plurality of cans or bottles of a beverage in vertical descendable disposition and at least one access opening at a lower end of the backpack in a position accessible to the hand of the person wearing the backpack.

2. Brief Description of the Prior Art

Portable liquid beverage dispensers adapted to be transported on the back of a vendor by use of a body harness are known in the art, as disclosed by way of example, in U.S. Pat. No. 2,732,977 to Charpiat and U.S. Pat. No. 2,808,965 to Grafia et al. Such portable dispensers include a tank made of rigid material enclosing a liquid storing chamber from which the beverage is dispensed and into which the beverage is charged through a reloading valve connected to the bottom of the tank. The beverage is accordingly dispensed under a gravitational pressure head. To assist in dispensing of the beverage, particularly when the liquid within the tank becomes depleted, the tank chamber may be internally pressurized with air by means of a pump as disclosed, for example, in U.S. Pat. No. 3,147,889 to Dolgin.

Motsenbocker, U.S. Pat. No. 4,420,097 discloses a portable liquid dispenser having an insulated carrying case which contains a first flexible container and a second flexible container positioned therein. A freezable liquid is contained in the second container and the liquid to be dispensed is contained in the first container in contact with the surface of the container with the frozen liquid to cool the liquid to be dispensed. The liquid is dispensed under gravitational pressure.

Boxer et al, U.S. Pat. No. 4,526,298 discloses a flexible water bag or pouch which may be insulated that is carried on shoulder straps similar to a back pack. The liquid is dispensed by a squeeze type dispensing nozzle.

Ash, U.S. Pat. Nos. 4,896,402 and 5,199,609 disclose a rigid dispenser tank with an outer insulated jacket and an interior flexible bladder which is pressurized to maintain the liquid under pressure.

Sims, U.S. Pat. No. 3,662,929 discloses a non-insulated rigid container with interior flexible bladder connected to a source of fluid pressure. A fluid substance to be dispensed is stored in the rigid container and the flexible bladder is inflated to discharge the fluid substance under pressure.

Uhlig, U.S. Pat. No. 4,098,434 discloses a non-insulated fluid product dispenser having first container and a second flexible container positioned inside the first container. Fluid to be dispensed is contained in one of the containers and fluid under pressure is introduced into the other container to urge the product fluid through a dispensing nozzle or opening.

Cornelius, U.S. Pat. No. 2,513,455 discloses a non-insulated rigid dispenser tank with an interior flexible bladder connected to a gas container. Fluid to be dispensed is stored in the rigid dispenser tank. The gas fed to the bladder condenses at the pressure and temperature at which the fluid in the container is to be discharged.

Shy, U.S. Pat. No. 4,300,705 discloses a compressed vacuum insulated bottle which operates by siphonage and compression of an elastic pouch in the top of the bottle stopper to siphon boiling water into the elastic pouch and then to drain off the boiling water by compression.

Billet, U.S. Pat. No. 4,921,143 discloses a portable beverage dispenser carried on the back of a vendor and has an insulated tank for containing a beverage, a hand pump for manually pressurizing the contents, and a thermally insulated dispensing hose.

One of the major problems with the above described portable dispensers which include a pressurized tank containing a beverage is that the tank requires periodic recharging and/or a separate gas supply tank or hand pump must also be transported in the backpack. Another problem is that the tank containing the beverage must be filled periodically and/or a relatively large number of filled tanks must be readily available.

Portable coolers and backpack coolers which are adapted to contain a number of individual beverage cans are also known in the art.

Calton, U.S. Pat. No. 4,673,117, discloses a backpack cooler that also serves as a seat which utilizes an insulated rigid foam core that is received inside a cloth sheath or jacket and has a rigid reinforcing liner which defines a well to hold two stacked six packs of 12 ounce can containers. The cloth jacket is retained on the cooler body by a retainer cord, and a pair of shoulder straps fasten to the cloth jacket. The entire structure is strong enough to support the weight of a person, so that it doubles as a seat. The jacket also has an uninsulated accessory pouch. There is no provision for dispensing the cans other than opening the lid of the foam core in the manner of a conventional insulated cooler.

Leslie, U.S. Pat. No. 4,721,237 discloses a portable cooler that may be carried in back-pack style which stores and automatically dispenses a number of cans of beverage. The cooler is comprised of a box-like chamber having self-supporting thermally insulative material on its exterior surfaces. One or more removable coolant-confining containers are positioned within the chamber, each having a serpentine contour of horizontally elongated recesses adapted to hold beverage cans and permit their vertical descent to a door positioned adjacent the bottom of the chamber. The chamber is held within a snug-fitting fabric carrying jacket having a zippered lid and closure for the door, and carrying straps. The door is not accessible to the hand of the person wearing the backpack.

The present invention is distinguished over the prior art in general, and these patents in particular, by a backpack carried on the back of a vendor for transporting and dispensing individual cans or bottles of a beverage which has at least one thermally insulated generally rectangular storage compartment configured to hold a plurality of cans or bottles of a beverage in vertical descendable disposition, a closable lid at the top end of the backpack, and at least one access opening at a lower end of the backpack in a position accessible to the hand of the person wearing the backpack. In a preferred embodiment, the backpack has a thermally insulated back wall, front wall, opposed side walls, bottom wall, and hinged top wall, a pair of laterally adjacent storage compartments, and a lower portion which extends laterally outward from the opposed side walls to define laterally opposed side extensions, and the back wall has a pair of laterally opposed access openings one in each side extension accessible to either hand of the person wearing the backpack by reaching rearwardly to manually withdraw a lowermost one of the cans or bottles from either storage compartment. A storage pouch may be releasably attached to the backpack to store empty cans or bottles. One or more panels may be installed on the exterior of the backpack which are imprinted with a picture or other advertising indicia to represent the type of beverage contained within the backpack. Alternatively, a hollow shell may be installed on the exterior of the backpack which is configured to resemble the shape of a beverage container of the type contained within the backpack.

SUMMARY OF THE INVENTION

It is therefore an object of this invention to provide a backpack beverage dispensing system which is suitable for containing and dispensing a number of individual cans or bottles of a beverage.

It is another object of the present invention to provide a backpack beverage dispensing system which is self contained and suitable to be carried on the back of a vendor.

Another object of this invention is to provide a backpack having at least one thermally insulated storage compartment for containing a plurality of cans or bottles of a beverage which will allow the cans or bottles of the beverage to be served at optimum temperatures.

Another object of this invention to provide a backpack having at least one thermally insulated generally rectangular storage compartment configured to hold a plurality of generally cylindrical cans or bottles of a beverage in vertical descendable disposition.

Another object of this invention to provide a backpack having a thermally insulated generally rectangular storage compartment configured to hold a plurality of cans or bottles of a beverage in vertical descendable disposition and at least one access opening disposed at a lower end of the backpack in a position to allow quick and easy access to the hand of the person wearing the backpack.

Another object of this invention is to provide a backpack having a pair of laterally adjacent storage compartments and a pair of laterally opposed access openings in a lower portion thereof which are easily and quickly accessible to either hand of the person wearing the backpack by reaching rearwardly to manually withdraw a can or bottle from either storage compartment.

Another object of this invention is to provide a backpack beverage dispensing system which has a storage pouch for containing a plurality of empty cans or bottles.

Another object of this invention is to provide a backpack beverage dispensing system having one or more panels on the exterior of the backpack which are imprinted with a picture or other advertising indicia to represent the type of beverage contained within the backpack.

A further object of this invention is to provide a backpack beverage dispensing system having a hollow shell installed on the exterior of the backpack which is configured to resemble the shape of a beverage container of the type contained within the backpack.

A still further object of this invention is to provide a portable beverage dispensing system which is aesthetically pleasing, simple in construction, economical to manufacture, and rugged and durable in use.

Other objects of the invention will become apparent from time to time throughout the specification and claims as hereinafter related.

The above noted objects and other objects of the invention are accomplished by a backpack carried on the back of a vendor for transporting and dispensing individual cans or bottles of a beverage which has at least one thermally insulated generally rectangular storage compartment configured to hold a plurality of cans or bottles of a beverage in vertical descendable disposition, a closable lid at the top end of the backpack, and at least one access opening disposed at a lower end of the backpack in a position accessible to the hand of the person wearing the backpack. In a preferred embodiment, the backpack has a thermally insulated back wall, front wall, opposed side walls, bottom wall, and hinged top wall, a pair of laterally adjacent storage compartments, and a lower portion which extends laterally outward from the opposed side walls to define laterally opposed side extensions, and the back wall has a pair of laterally opposed access openings one in each side extension accessible to either hand of the person wearing the backpack by reaching rearwardly to manually withdraw a lowermost one of the cans or bottles from either storage compartment. A storage pouch may be releasably attached to the backpack to store empty cans or bottles. One or more panels may be installed on the exterior of the backpack which are imprinted with a picture or other advertising indicia to represent the type of beverage contained within the backpack. Alternatively, a hollow shell may be installed on the exterior of the backpack which is configured to resemble the shape of a beverage container of the type contained within the backpack.

DESCRIPTION OF THE PREFERRED EMBODIMENT

Figure 1:
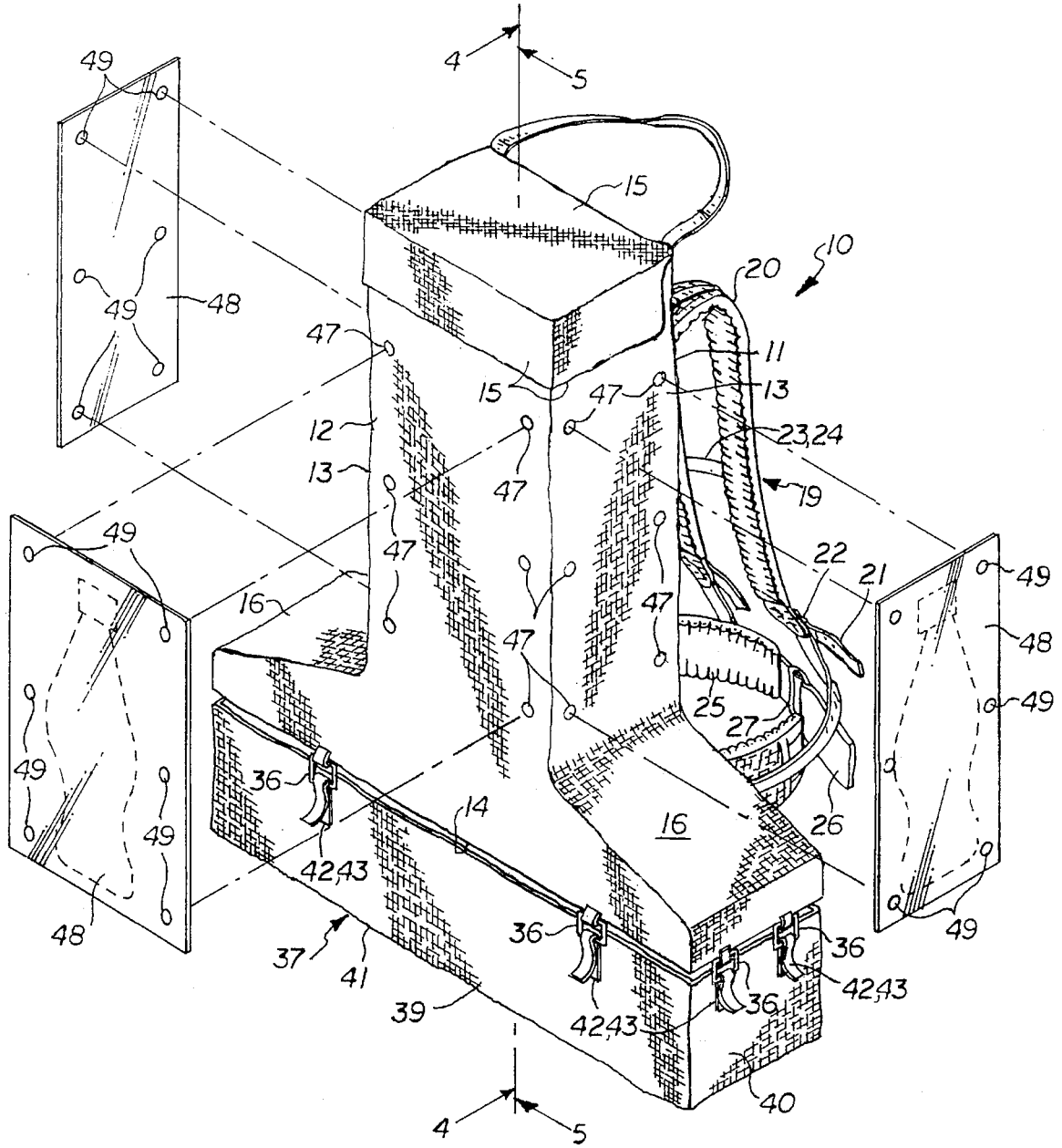
FIG. 1 is a perspective view of a backpack in accordance with the present invention.
Figure 2:
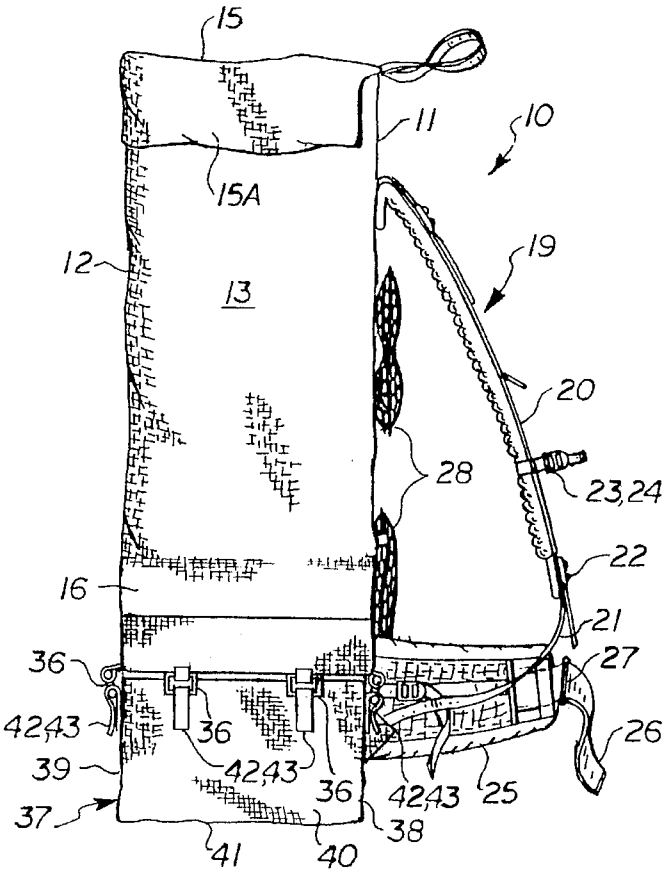
FIG. 2 is a side elevation of the backpack.
Figure 3:
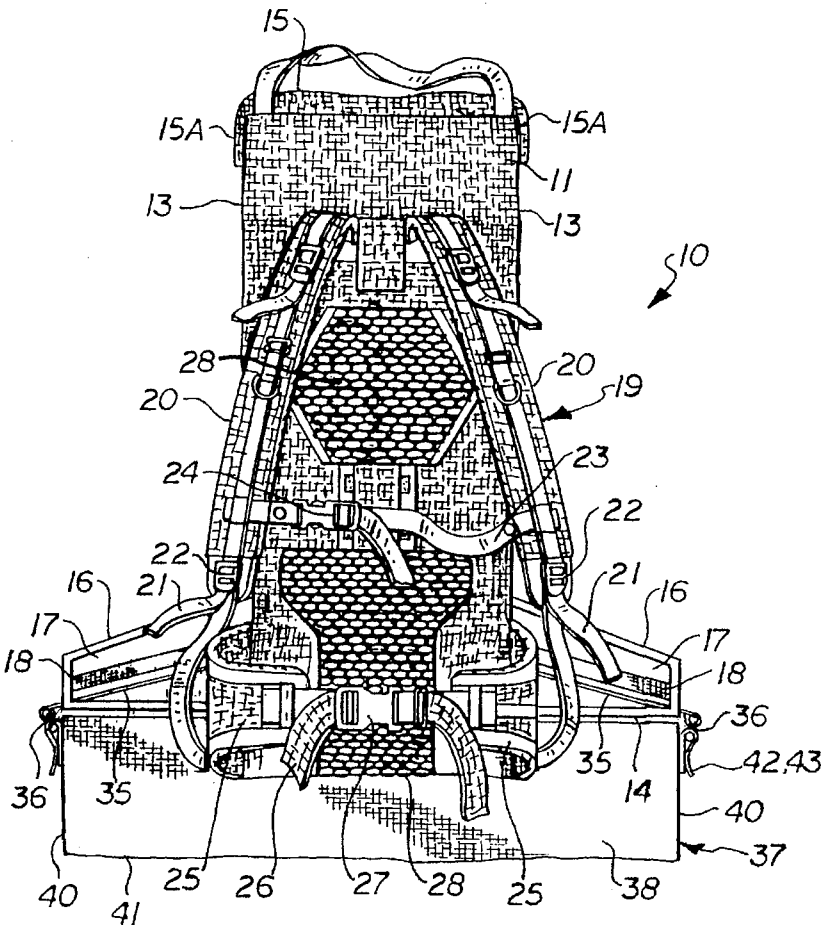
FIG. 3 is a rear elevation of the backpack.
Figure 4:
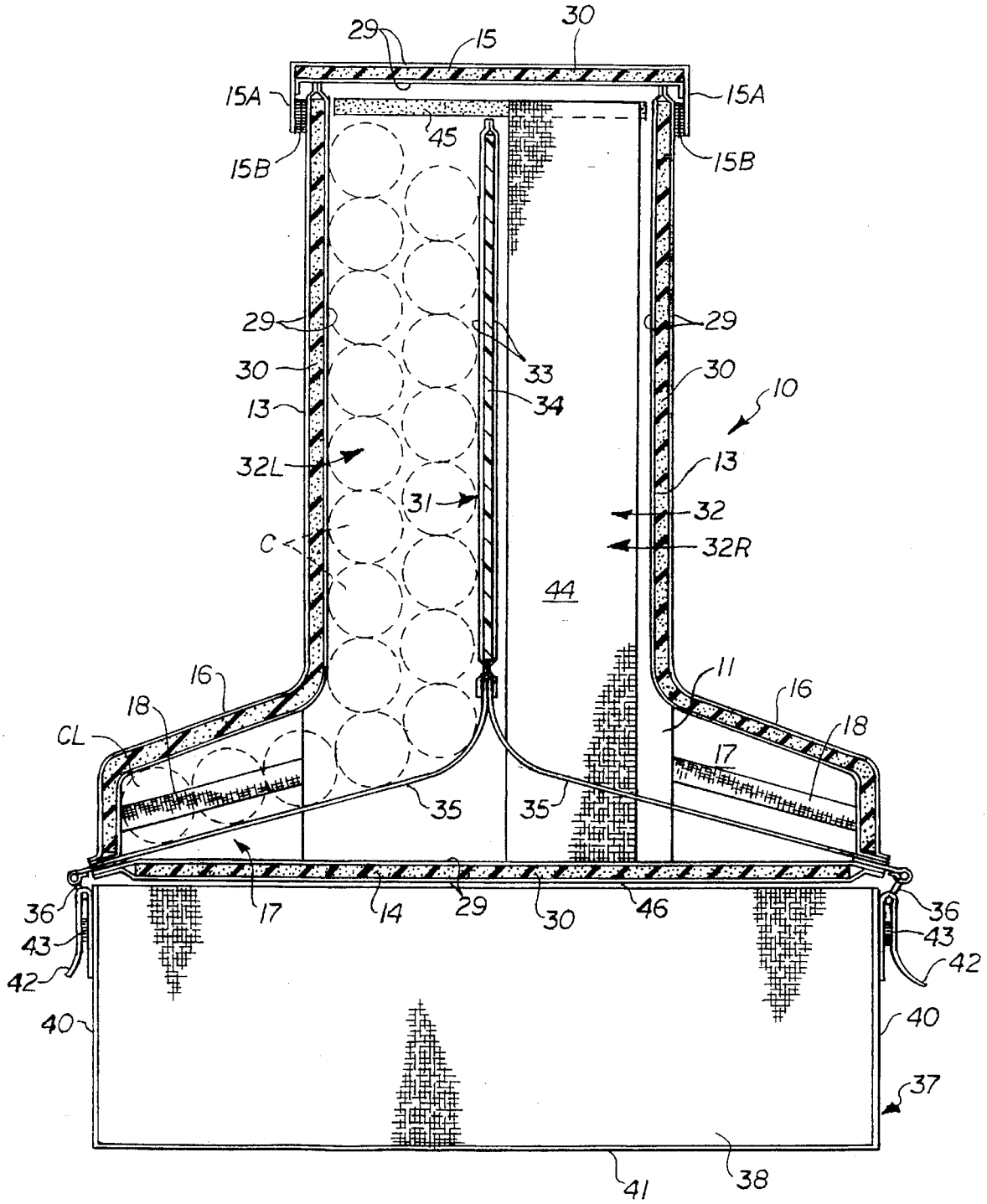
FIG. 4 is a longitudinal cross section through the backpack taken along line 4—4 of FIG. 1, showing the interior of the backpack.

Referring to the drawings by numerals of reference, there is shown in FIGS. 1, 2, and 3, a backpack 10 particularly suited for transporting and dispensing a number of individual cans or bottles of beverage which is adapted to be carried on the back of a vendor. The backpack 10 has a back wall 11, a front wall 12, opposed side walls 13, a bottom wall 14, and a hinged top closure 16 defining a generally rectangular interior compartment. The lower portion of the backpack just above the bottom wall 14 extends laterally outward and downward from the opposed side walls 12 to define laterally opposed generally triangular portions 16. As best seen in FIGS. 3 and 4, the triangular portions 16 of the back wall 11 are open to form generally triangular openings 17. An elastic strap 18 is secured across each opening 17.

A shoulder harness 19 is secured to the backpack 10 and has a pair of padded shoulder straps 20, each of which are connected to the backpack by an adjustment strap 21 and adjustment buckle 22 and are interconnected by a transverse chest strap 23 and adjustment buckle 24 to permit proper adjustment of the shoulder straps about the shoulders and chest of the vendor. The backpack 10 is also provided with a pair of padded waist belt sections 25 interconnected by an adjustment strap 26 and adjustment buckle 27 for encircling the waist of the vendor. One or more back pads 28 may also be secured to the back wall 11 of the backpack 10 to provide added comfort to the wearer.

Figure 5:
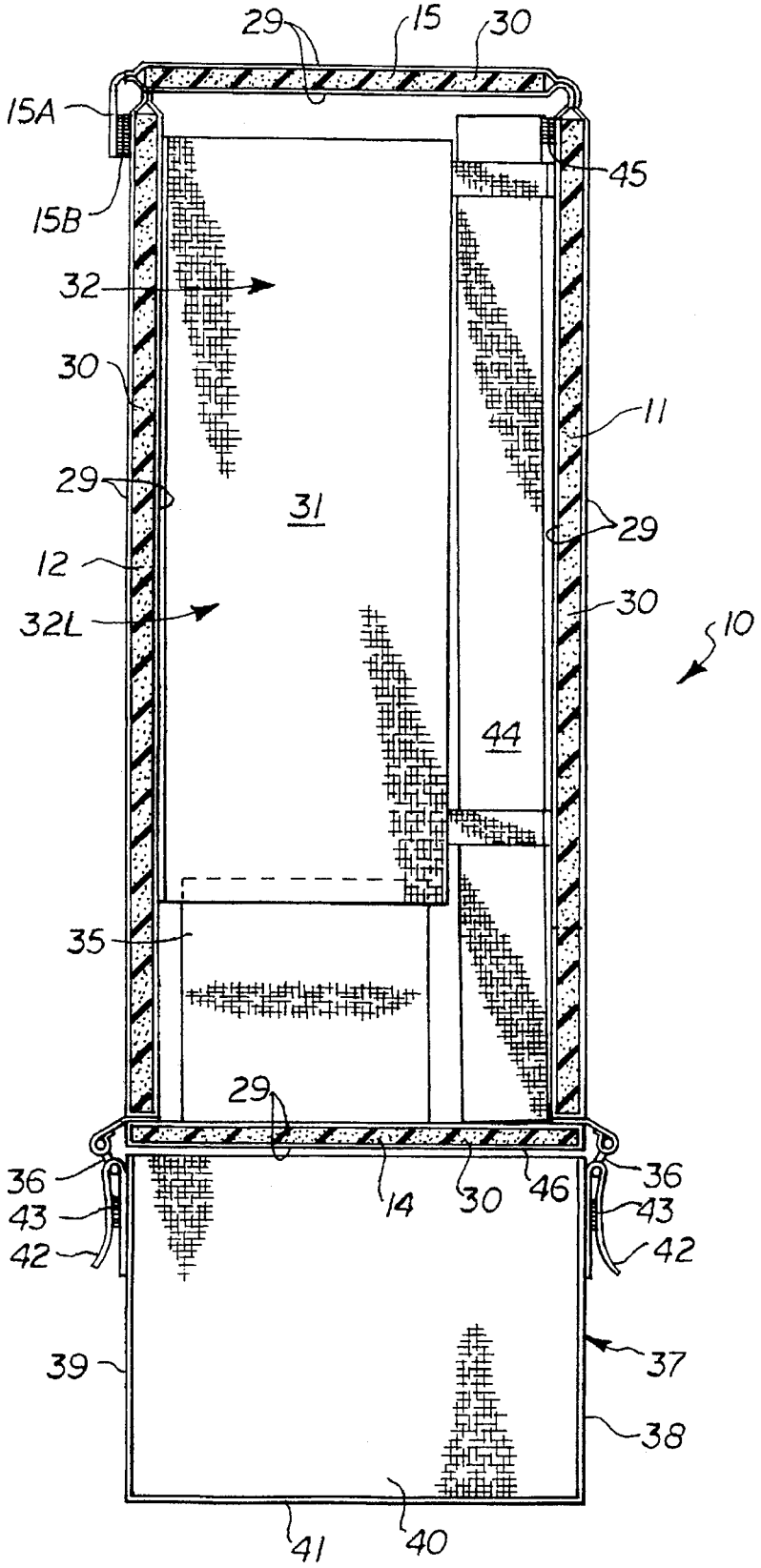
FIG. 5 is a longitudinal cross section through the backpack taken along line 5—5 of FIG. 1, showing the interior of the backpack.

Referring now to FIGS. 4 and 5, the backpack 10 is shown in longitudinal cross section, however the previously shown and described shoulder harness, straps, waist belt, and buckles are not shown to avoid confusion. As seen in FIGS. 4 and 5, the back wall 11, front wall 12, opposed side walls 13, bottom wall 14, and hinged top closure 15 are formed of two plies of a suitable flexible fabric material 29, such as nylon or canvas, between which a semi-rigid rectangular piece of thermally insulating elastomeric material 30 such as foam plastic or foam rubber is disposed. The back wall 11 and bottom wall 14 may also be provided with one or more rectangular rigid panels or strips (not shown) vertically disposed between the plies of fabric material to stiffen and reinforce the back and bottom walls. The top closure 15 is hinged along one edge to the back wall 11 and has a depending skirt 15A on the front and side edges. The top closure 15 is releasably secured to the open top end of the compartment by mating hook and loop fasteners 15B installed on the underside of the skirt 15A and exterior of the upper end of the backpack 10.

A vertically extending rectangular divider 31 is attached perpendicularly between the front and back walls 12 and 11, respectively, of the backpack 10 to divide the interior compartment 32 into right and left compartments 32R and 32L. The rectangular divider 31 is formed of two plies of a suitable flexible fabric material 33 between which a rigid rectangular panel 34 or semi-rigid rectangular piece of thermally insulating elastomeric material such as foam plastic or foam rubber is disposed.

A pair of generally rectangular panels 35 are secured at their upper ends to the lower portion of the divider 31 and extend laterally outward and downwardly therefrom in opposed relation and their lower ends are secured to the bottom wall 14. The panels 35 extend angularly across the triangular openings 17 in the back wall 11 and serve as dispensing ramps, as described hereinafter.

D-rings 36 are secured in spaced relation along the bottom edges of the back wall 11, front wall 12, and opposed side walls 13 at their juncture with the bottom wall 14. A generally rectangular storage pouch 37 having a back wall 38, front wall 39, opposed side walls 40 and a bottom wall 41 is removably attached by straps 42 to the bottom of the backpack 10. The straps 42 are looped through the D-rings 36 and are releasably secured by mating hook and loop fasteners 43 on the straps. The pouch 37 is formed of a suitable flexible fabric such as nylon or canvas and is used for storing empty cans and bottles.

The right and left compartments 32R and 32L are sized to hold a plurality of generally cylindrical cans or bottles of beverage C which may be stacked in columns and rows, as shown in dotted line in FIG. 4. A pair of rectangular spacers 44 may also be installed in the compartments 32R and 32L to adapt the compartments to receive cans and bottles of different size. The spacers 44 are formed of a rectangular pad of elastomeric material covered by a suitable fabric and may be releasably fastened to extend vertically along the interior of the back wall 11 by mating hook and loop fasteners 45 installed on the interior of the back wall 11 and exterior of the spacers 44.

The cold cans or bottles of beverage are stacked in columns and rows, as shown in dotted line in FIG. 4, and the lowermost row of cans or bottles are supported on the dispensing panels 35, with the outermost can or bottle CL in alignment with the corresponding triangular opening 17, but is held in place by the elastic strap 18. The vendor reaches back with his right or left hand, and moving the elastic strap aside, reaches through the triangular opening 17 and pulls the outermost can or bottle out of the backpack.

The lateral spacing of the D-rings 36 and straps 42 is such that a small space 46 is provided between the open top end of the flexible storage pouch 37 and the bottom wall 14 of the backpack 10. Empty cans or bottles may be pushed through the space 46 into the storage pouch 37 without unfastening the straps 42. After the storage pouch 37 is full of empty cans or bottles, the pouch can be removed and emptied by unfastening the straps 42.

Referring again to FIG. 1, a plurality of snap fasteners 47 may be provided on the exterior of the backpack 10, and a plurality of rectangular panels 48 having mating snap fasteners 49 thereon may be releasably attached to the exterior of the walls of the backpack. The rectangular panels 48 are imprinted with pictures or other advertising indicia to represent the type of beverage contained within the vendor's backpack.

Figure 6:
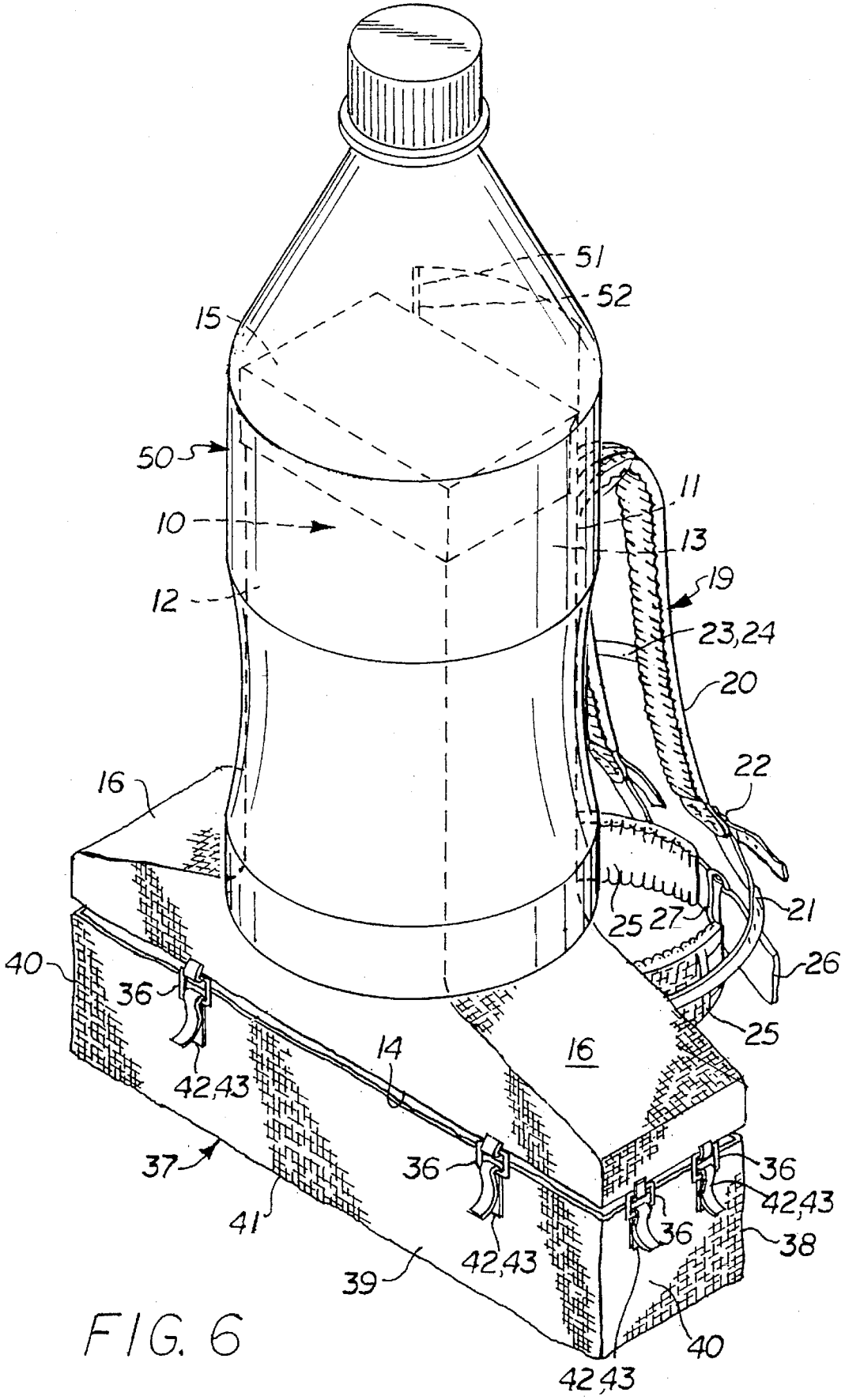
FIG. 6 is an exploded perspective view of the backpack with a hollow shell installed on the exterior of the backpack.

Alternatively, as shown in FIG. 6, a hollow shell 50 formed into the shape of the beverage container that is contained in the backpack 10 may be installed over the backpack to identify the beverage carried by the vendor. In this embodiment, the shell 50 would have a slot or opening 51 in its side wall 52 to allow the shoulder harness 19 to extend therethrough.

While this invention has been described fully and completely with special emphasis upon a preferred embodiment, it should be understood that within the scope of the appended claims the invention may be practiced otherwise than as specifically described herein.

I claim:

1. A backpack to be worn on the back of a person for transporting and dispensing containers of a beverage comprising:

a backpack having an adjustable shoulder harness adapted to receive two shoulders of a person and having a back wall, front wall, opposed side walls, and a bottom wall formed of thermally insulating material defining at least one generally rectangular storage compartment configured to hold a plurality of generally cylindrical cans or bottles of a beverage in a vertically descendable disposition;

an opening at a top end of said backpack for placing said cans or bottles into said at least one storage compartment;

at least one access opening disposed at a lower end of said backpack through which a lowermost one of said cans or bottles may pass; and support means disposed at a lower end of said backpack adjacent said at least one access opening, said support means extending laterally outward from a central compartment to define laterally opposed side portions with configured to support a lowermost one of said cans or bottles laterally outward from a side of said at least one generally rectangular storage compartment in a position accessible to a hand of the person wearing said backpack for the manual removal of said lowermost one of said cans or bottles.

2. The backpack according to claim 1 further comprising retaining means secured across said at least one access opening to prevent accidental passage of said lowermost one of said cans or bottles through said at least one access opening.

3. The backpack according to claim 1 wherein said support means comprises an inclined support member having an upper end in said at least one generally rectangular storage compartment lower end and having a lower end extending angularly downward therefrom and laterally outward from a side of said at least one generally rectangular storage compartment for supporting and positioning a number of said lowermost cans or bottles thereon in a row in single file with an outermost one of said lowermost cans or bottles positioned laterally outward from said generally rectangular storage compartment adjacent said access opening.

4. The backpack according to claim 1 wherein said backpack has a closable top cover hinged to said opening at said top end for enclosing said at least one generally rectangular storage compartment.

5. The backpack according to claim 1 wherein said backpack has an adjustable waist belt secured to said back wall to encircle the waist of the person wearing said backpack.

6. The backpack according to claim 5 further comprising at least one back pad secured to said back wall of said backpack.

7. The backpack according to claim 1 further comprising a generally rectangular storage pouch releasably connected to said backpack bottom wall and having an opening at one end thereof for receiving a plurality of empty cans or bottles.

8. The backpack according to claim 7 wherein said storage pouch is a generally rectangular pouch having an open top end releasably connected to said bottom wall in spaced relation to provide a space therebetween through which empty cans or bottled may be passed and stored in said pouch.

9. The backpack according to claim 1 wherein said back wall, front wall, opposed side walls, and bottom wall are formed of two plies of a flexible material between which a thermally insulating material is disposed.

10. A backpack carried on the body of a person for transporting and dispensing containers of a beverage comprising:

a backpack adapted to be worn on the back of a person and having a back wall, a front wall, opposed side walls, and a bottom wall defining at least one generally rectangular storage compartment configured to hold a plurality of generally cylindrical cans or bottles of a beverage in a vertically descendable disposition;

an opening at a top end of said backpack for placing said cans or bottles into said at least one storage compartment;

said backpack having a lower portion which extends laterally outward and downward from said opposed side walls to define laterally opposed generally triangular side portions; and said back wall having a pair of laterally opposed access openings one in each said generally triangular side portion accessible to either hand of the person wearing said backpack by reaching rearwardly to manually withdraw a lowermost one of said cans or bottles from said at least one storage compartment.

11. The backpack according to claim 10 further comprising retaining means secured across each said access opening to prevent accidental egress of said lowermost one of said cans or bottles from said at least one storage compartment.

12. The backpack according to claim 1 wherein said backpack has a pair of laterally adjacent generally rectangular storage compartments separated by a divider panel extending between said front and back walls;

each of said pair of generally rectangular storage compartments is configured to hold a plurality of generally cylindrical cans or bottles of a beverage in a vertically descendable disposition; and said at least one access opening comprises a pair of laterally spaced access openings each disposed at a lower end of said backpack laterally outward from one side of each said generally rectangular storage compartment;

said support means comprises a pair of laterally opposed support members disposed at a lower end of said backpack configured to support a pair of lowermost cans or bottles adjacent a respective said access opening each in a position laterally outward from said one side of each said generally rectangular storage compartment in a position accessible to either hand of the person wearing said backpack for the manual removal of a selected one of said lowermost cans or bottles from either of said pair of storage compartments.

13. The backpack according to claim 12 further comprising retaining means secured across each one of said pair of access openings to prevent accidental passage of said lowermost ones of said cans or bottles through said pair of access openings.

14. The backpack according to claim 12 wherein each said support member comprises an inclined support member having an upper end in a respective one of said pair of generally rectangular storage compartments and having a lower end extending angularly downward therefrom and laterally outward from a side of said respective storage compartment for supporting and positioning a number of lowermost said cans or bottles thereon in a row in single file with an outermost pair of said lowermost cans or bottles positioned laterally outward from the respective storage compartment adjacent a respective one of said pair of access openings.

15. The backpack according to claim 12 wherein said backpack lower end has a lower portion which extends laterally outward and downward from said opposed side walls to define laterally opposed generally triangular side portions; and each of said access openings comprises an opening in said back wall of said generally triangular side portions.

16. The backpack according to claim 1 further comprising fastener means on an exterior surface of said backpack; and at least one panel having mating fastener means thereon for releasably attaching said panel to the exterior of said backpack;

said at least one panel imprinted with pictures or other advertising indicia to represent the type of beverage contained within said backpack.

17. A backpack carried on the body of a person for transporting and dispensing containers of a beverage comprising:

a backpack adapted to be worn on the back of a person and having at least one generally rectangular storage compartment configured to hold a plurality of generally cylindrical cans or bottles of a beverage in vertically descendable disposition;

an opening at a top end of said backpack for placing said cans or bottles into said at least one storage compartment;

at least one access opening disposed at a lower end of said backpack in a position accessible to a hand of the person wearing said backpack for the manual withdrawal of a lowermost one of said cans or bottles from said at least one storage compartment; and a hollow shell adapted to be received on the exterior of said backpack;

said hollow shell configured to resemble the shape of a beverage container of the type contained within said backpack.

18. A method of transporting and dispensing a plurality of cans or bottles of a beverage comprising the steps of;

providing a backpack adapted to be worn on the back of a person;

said backpack having at least one generally rectangular storage compartment with an open top end, at least one access opening disposed at a lower end of said backpack, and support means disposed at said lower end adjacent said at least one access opening, said support means extending laterally outward from a central compartment to define laterally opposed side portion with configured to support a lowermost one of a plurality of cans or bottles laterally outward from a side of said at least one generally rectangular storage compartment in a position accessible to a hand of the person wearing said backpack;

placing a plurality of generally cylindrical cans or bottles of a beverage in said at least one storage compartment in a vertically descendable disposition such that a lowermost one of said plurality of cans or bottles is supported laterally outward from a side of said at least one generally rectangular storage compartment;

installing at least one panel on the exterior of said backpack which is imprinted with a picture or other advertising indicia to represent the type of beverage contained within said backpack;

placing said backpack on the back of said person; and said person manually dispensing individual cans or bottles from said backpack by reaching rearwardly and manually removing said laterally outward supported lowermost one of said cans or bottles.

19. A method of transporting and dispensing a plurality of cans or bottles of a beverage comprising the steps of:

providing a backpack adapted to be worn on the back of a person;

said backpack having at least one generally rectangular storage compartment with an open top end, and at least one access opening disposed at a lower end of said backpack in a position accessible to a hand of the person wearing said backpack;

placing a plurality of generally cylindrical cans or bottles of a beverage in said at least one storage compartment in a vertically descendable disposition;

installing a hollow shell on the exterior of said backpack which is configured to resemble the shape of a beverage container of the type contained within said backpack;

placing said backpack on the back of said person; and said person manually dispensing individual cans or bottles from said backpack by reaching into said at least one access opening and manually withdrawing a lowermost one of said cans or bottles from said at least one storage compartment.

* * * * *